US011335992B2

(12) United States Patent
Edwards et al.

(10) Patent No.: US 11,335,992 B2
(45) Date of Patent: May 17, 2022

(54) INTEGRATED MILLIMETER WAVE ANTENNA MODULES

(71) Applicant: Apple Inc., Cupertino, CA (US)

(72) Inventors: Jennifer M. Edwards, San Francisco, CA (US); Siwen Yong, Mountain View, CA (US); Jiangfeng Wu, San Jose, CA (US); Harish Rajagopalan, San Jose, CA (US); Bilgehan Avser, San Bruno, CA (US); Simone Paulotto, Redwood City, CA (US); Mattia Pascolini, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 16/990,879

(22) Filed: Aug. 11, 2020

(65) Prior Publication Data

US 2021/0075088 A1 Mar. 11, 2021

Related U.S. Application Data

(60) Provisional application No. 62/896,140, filed on Sep. 5, 2019.

(51) Int. Cl.

| | |
|---|---|
| ***H01Q 1/22*** | (2006.01) |
| ***H01Q 5/335*** | (2015.01) |
| ***H01Q 5/392*** | (2015.01) |
| ***H01Q 23/00*** | (2006.01) |
| ***H01Q 1/24*** | (2006.01) |

(52) U.S. Cl.

CPC ..... *H01Q 1/2283* (2013.01); *H01Q 1/243* (2013.01); *H01Q 5/335* (2015.01); *H01Q 5/392* (2015.01); *H01Q 23/00* (2013.01)

(58) Field of Classification Search

CPC ..... H01Q 1/2283; H01Q 23/00; H01Q 1/243; H01Q 5/335

USPC ..... 343/702

See application file for complete search history.

(56) References Cited

U.S. PATENT DOCUMENTS

| | | | |
|---|---|---|---|
| 9,667,290 | B2 | 5/2017 | Ouyang et al. |
| 10,418,687 | B2 | 9/2019 | Mow et al. |
| 2003/0078037 | A1 | 4/2003 | Auckland et al. |
| 2019/0229433 | A1* | 7/2019 | Labonte ..... H01Q 9/0457 |
| 2020/0052373 | A1 | 2/2020 | Xia et al. |
| 2020/0127361 | A1 | 4/2020 | Lee et al. |
| 2020/0220255 | A1 | 7/2020 | Cetinoneri et al. |

(Continued)

*Primary Examiner* — Peguy Jean Pierre

(74) *Attorney, Agent, or Firm* — Treyz Law Group, P.C.; Michael H. Lyons

(57) ABSTRACT

An electronic device may be provided with an antenna module and a phased antenna array on the module. The module may include a logic board, an antenna board surface-mounted to the logic board, and a radio-frequency integrated circuit (RFIC) mounted surface-mounted to the logic board. The phased antenna array may include antennas embedded in the antenna board. The antennas may radiate at centimeter and/or millimeter wave frequencies. The logic board may form a radio-frequency interface between the RFIC and the antennas. Transmission lines in the logic board and the antenna board may include impedance matching segments that help to match the impedance of the RFIC to the impedance of the antennas. The module may efficiently utilize space within the device without sacrificing radio-frequency performance.

20 Claims, 13 Drawing Sheets

(56) References Cited

U.S. PATENT DOCUMENTS

2020/0348393 A1* 11/2020 Trotta ..... H01Q 1/38
2021/0210441 A1* 7/2021 Kim ..... H01L 23/66

* cited by examiner

INTEGRATED MILLIMETER WAVE ANTENNA MODULES

This application claims the benefit of provisional patent application No. 62/896,140, filed Sep. 5, 2019, which is hereby incorporated by reference herein in its entirety.

BACKGROUND

This relates generally to electronic devices and, more particularly, to electronic devices with wireless circuitry.

Electronic devices often include wireless circuitry. For example, cellular telephones, computers, and other devices often contain antennas and wireless transceivers for supporting wireless communications.

It may be desirable to support wireless communications in millimeter wave and centimeter wave communications bands. Millimeter wave communications, which are sometimes referred to as extremely high frequency (EHF) communications, and centimeter wave communications involve communications at frequencies of about 10-300 GHz. Operation at these frequencies may support high bandwidths but may raise significant challenges. For example, radio-frequency communications in millimeter and centimeter wave communications bands can be characterized by substantial attenuation and/or distortion during signal propagation through various mediums.

It would therefore be desirable to be able to provide electronic devices with improved wireless circuitry such as wireless circuitry that supports millimeter and centimeter wave communications.

SUMMARY

An electronic device may be provided with wireless circuitry. The wireless circuitry may include a logic-board-integrated antenna module and a phased antenna array on the module. The module may include a logic board, an antenna board surface-mounted to the logic board, and a radio-frequency integrated circuit (RFIC) mounted surface-mounted to the logic board. The phased antenna array may include antennas embedded in the antenna board. The antennas may radiate at centimeter and/or millimeter wave frequencies.

The logic board may form a radio-frequency interface between the RFIC and the antennas. For example, transmission lines in the logic board may couple the RFIC to the antenna board. The transmission lines may include impedance matching segments that help to match the impedance of the RFIC to the impedance of the antennas. The antenna board may also include transmission lines with impedance matching segments. The module may efficiently utilize space within the device without sacrificing radio-frequency performance.

DETAILED DESCRIPTION

Figure 1:
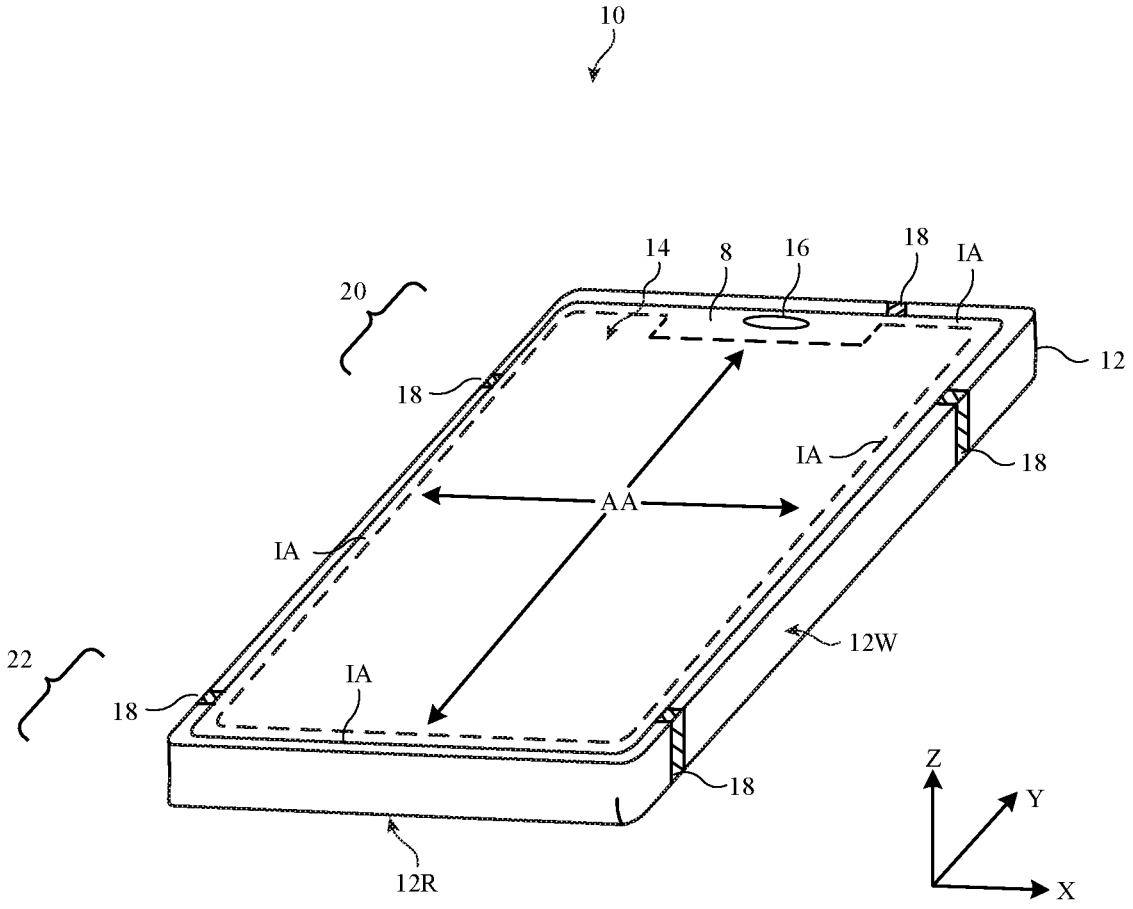
FIG. 1 is a perspective view of an illustrative electronic device in accordance with some embodiments.

An electronic device such as electronic device 10 of FIG. 1 may contain wireless circuitry. The wireless circuitry may include one or more antennas. The antennas may include phased antenna arrays that are used for performing wireless communications using millimeter and centimeter wave signals. Millimeter wave signals, which are sometimes referred to as extremely high frequency (EHF) signals, propagate at frequencies above about 30 GHz (e.g., at 60 GHz or other frequencies between about 30 GHz and 300 GHz). Centimeter wave signals propagate at frequencies between about 10 GHz and 30 GHz. If desired, device 10 may also contain antennas for handling satellite navigation system signals, cellular telephone signals, local wireless area network signals, near-field communications, light-based wireless communications, or other wireless communications.

Electronic device 10 may be a portable electronic device or other suitable electronic device. For example, electronic device 10 may be a laptop computer, a tablet computer, a somewhat smaller device such as a wrist-watch device, pendant device, headphone device, earpiece device, or other wearable or miniature device, a handheld device such as a cellular telephone, a media player, or other small portable device. Device 10 may also be a set-top box, a desktop computer, a display into which a computer or other processing circuitry has been integrated, a display without an integrated computer, a wireless access point, a wireless base station, an electronic device incorporated into a kiosk, building, or vehicle, or other suitable electronic equipment.

Device 10 may include a housing such as housing 12. Housing 12, which may sometimes be referred to as a case, may be formed of plastic, glass, ceramics, fiber composites, metal (e.g., stainless steel, aluminum, etc.), other suitable materials, or a combination of these materials. In some situations, parts of housing 12 may be formed from dielectric or other low-conductivity material (e.g., glass, ceramic, plastic, sapphire, etc.). In other situations, housing 12 or at least some of the structures that make up housing 12 may be formed from metal elements.

Device 10 may, if desired, have a display such as display 14. Display 14 may be mounted on the front face of device 10. Display 14 may be a touch screen that incorporates capacitive touch electrodes or may be insensitive to touch. The rear face of housing 12 (i.e., the face of device 10 opposing the front face of device 10) may have a substantially planar housing wall such as rear housing wall 12R (e.g., a planar housing wall). Rear housing wall 12R may have slots that pass entirely through the rear housing wall and that therefore separate portions of housing 12 from each other. Rear housing wall 12R may include conductive portions and/or dielectric portions. If desired, rear housing wall 12R may include a planar metal layer covered by a thin layer or coating of dielectric such as glass, plastic, sapphire, or ceramic. Housing 12 may also have shallow grooves that do not pass entirely through housing 12. The slots and grooves may be filled with plastic or other dielectrics. If desired, portions of housing 12 that have been separated from each other (e.g., by a through slot) may be joined by internal conductive structures (e.g., sheet metal or other metal members that bridge the slot).

Housing 12 may include peripheral housing structures such as peripheral structures 12W. Conductive portions of peripheral structures 12W and conductive portions of rear housing wall 12R may sometimes be referred to herein collectively as conductive structures of housing 12. Peripheral structures 12W may run around the periphery of device 10 and display 14. In configurations in which device 10 and display 14 have a rectangular shape with four edges, peripheral structures 12W may be implemented using peripheral housing structures that have a rectangular ring shape with four corresponding edges and that extend from rear housing wall 12R to the front face of device 10 (as an example). Peripheral structures 12W or part of peripheral structures 12W may serve as a bezel for display 14 (e.g., a cosmetic trim that surrounds all four sides of display 14 and/or that helps hold display 14 to device 10) if desired. Peripheral structures 12W may, if desired, form sidewall structures for device 10 (e.g., by forming a metal band with vertical sidewalls, curved sidewalls, etc.).

Peripheral structures 12W may be formed of a conductive material such as metal and may therefore sometimes be referred to as peripheral conductive housing structures, conductive housing structures, peripheral metal structures, peripheral conductive sidewalls, peripheral conductive sidewall structures, conductive housing sidewalls, peripheral conductive housing sidewalls, sidewalls, sidewall structures, or a peripheral conductive housing member (as examples). Peripheral conductive housing structures 12W may be formed from a metal such as stainless steel, aluminum, or other suitable materials. One, two, or more than two separate structures may be used in forming peripheral conductive housing structures 12W.

It is not necessary for peripheral conductive housing structures 12W to have a uniform cross-section. For example, the top portion of peripheral conductive housing structures 12W may, if desired, have an inwardly protruding ledge that helps hold display 14 in place. The bottom portion of peripheral conductive housing structures 12W may also have an enlarged lip (e.g., in the plane of the rear surface of device 10). Peripheral conductive housing structures 12W may have substantially straight vertical sidewalls, may have sidewalls that are curved, or may have other suitable shapes. In some configurations (e.g., when peripheral conductive housing structures 12W serve as a bezel for display 14), peripheral conductive housing structures 12W may run around the lip of housing 12 (i.e., peripheral conductive housing structures 12W may cover only the edge of housing 12 that surrounds display 14 and not the rest of the sidewalls of housing 12).

Rear housing wall 12R may lie in a plane that is parallel to display 14. In configurations for device 10 in which some or all of rear housing wall 12R is formed from metal, it may be desirable to form parts of peripheral conductive housing structures 12W as integral portions of the housing structures forming rear housing wall 12R. For example, rear housing wall 12R of device 10 may include a planar metal structure and portions of peripheral conductive housing structures 12W on the sides of housing 12 may be formed as flat or curved vertically extending integral metal portions of the planar metal structure (e.g., housing structures 12R and 12W may be formed from a continuous piece of metal in a unibody configuration). Housing structures such as these may, if desired, be machined from a block of metal and/or may include multiple metal pieces that are assembled together to form housing 12. Rear housing wall 12R may have one or more, two or more, or three or more portions. Peripheral conductive housing structures 12W and/or conductive portions of rear housing wall 12R may form one or more exterior surfaces of device 10 (e.g., surfaces that are visible to a user of device 10) and/or may be implemented using internal structures that do not form exterior surfaces of device 10 (e.g., conductive housing structures that are not visible to a user of device 10 such as conductive structures that are covered with layers such as thin cosmetic layers, protective coatings, and/or other coating layers that may include dielectric materials such as glass, ceramic, plastic, or other structures that form the exterior surfaces of device 10 and/or serve to hide peripheral conductive housing structures 12W and/or conductive portions of rear housing wall 12R from view of the user).

Display 14 may have an array of pixels that form an active area AA that displays images for a user of device 10. For example, active area AA may include an array of display pixels. The array of pixels may be formed from liquid crystal display (LCD) components, an array of electrophoretic pixels, an array of plasma display pixels, an array of organic light-emitting diode display pixels or other light-emitting diode pixels, an array of electrowetting display pixels, or display pixels based on other display technologies. If desired, active area AA may include touch sensors such as touch sensor capacitive electrodes, force sensors, or other sensors for gathering a user input.

Display 14 may have an inactive border region that runs along one or more of the edges of active area AA. Inactive area IA of display 14 may be free of pixels for displaying images and may overlap circuitry and other internal device structures in housing 12. To block these structures from view by a user of device 10, the underside of the display cover layer or other layers in display 14 that overlap inactive area IA may be coated with an opaque masking layer in inactive area IA. The opaque masking layer may have any suitable color. Inactive area IA may include a recessed region such as notch 8 that extends into active area AA. Active area AA may, for example, be defined by the lateral area of a display module for display 14 (e.g., a display module that includes pixel circuitry, touch sensor circuitry, etc.). The display module may have a recess or notch in upper region 20 of device 10 that is free from active display circuitry (i.e., that forms notch 8 of inactive area IA). Notch 8 may be a substantially rectangular region that is surrounded (defined) on three sides by active area AA and on a fourth side by peripheral conductive housing structures 12W.

Display 14 may be protected using a display cover layer such as a layer of transparent glass, clear plastic, transparent ceramic, sapphire, or other transparent crystalline material, or other transparent layer(s). The display cover layer may have a planar shape, a convex curved profile, a shape with planar and curved portions, a layout that includes a planar main area surrounded on one or more edges with a portion that is bent out of the plane of the planar main area, or other suitable shapes. The display cover layer may cover the entire front face of device 10. In another suitable arrangement, the display cover layer may cover substantially all of the front face of device 10 or only a portion of the front face of device 10. Openings may be formed in the display cover layer. For example, an opening may be formed in the display cover layer to accommodate a button. An opening may also be formed in the display cover layer to accommodate ports such as speaker port 16 in notch 8 or a microphone port. Openings may be formed in housing 12 to form communications ports (e.g., an audio jack port, a digital data port, etc.) and/or audio ports for audio components such as a speaker and/or a microphone if desired.

Display 14 may include conductive structures such as an array of capacitive electrodes for a touch sensor, conductive lines for addressing pixels, driver circuits, etc. Housing 12 may include internal conductive structures such as metal frame members and a planar conductive housing member (sometimes referred to as a backplate) that spans the walls of housing 12 (i.e., a substantially rectangular sheet formed from one or more metal parts that is welded or otherwise connected between opposing sides of peripheral conductive structures 12W). The backplate may form an exterior rear surface of device 10 or may be covered by layers such as thin cosmetic layers, protective coatings, and/or other coatings that may include dielectric materials such as glass, ceramic, plastic, or other structures that form the exterior surfaces of device 10 and/or serve to hide the backplate from view of the user. Device 10 may also include conductive structures such as printed circuit boards, components mounted on printed circuit boards, and other internal conductive structures. These conductive structures, which may be used in forming a ground plane in device 10, may extend under active area AA of display 14, for example.

In regions 22 and 20, openings may be formed within the conductive structures of device 10 (e.g., between peripheral conductive housing structures 12W and opposing conductive ground structures such as conductive portions of rear housing wall 12R, conductive traces on a printed circuit board, conductive electrical components in display 14, etc.). These openings, which may sometimes be referred to as gaps, may be filled with air, plastic, and/or other dielectrics and may be used in forming slot antenna resonating elements for one or more antennas in device 10, if desired.

Conductive housing structures and other conductive structures in device 10 may serve as a ground plane for the antennas in device 10. The openings in regions 22 and 20 may serve as slots in open or closed slot antennas, may serve as a central dielectric region that is surrounded by a conductive path of materials in a loop antenna, may serve as a space that separates an antenna resonating element such as a strip antenna resonating element or an inverted-F antenna resonating element from the ground plane, may contribute to the performance of a parasitic antenna resonating element, or may otherwise serve as part of antenna structures formed in regions 22 and 20. If desired, the ground plane that is under active area AA of display 14 and/or other metal structures in device 10 may have portions that extend into parts of the ends of device 10 (e.g., the ground may extend towards the dielectric-filled openings in regions 22 and 20), thereby narrowing the slots in regions 22 and 20.

In general, device 10 may include any suitable number of antennas (e.g., one or more, two or more, three or more, four or more, etc.). The antennas in device 10 may be located at opposing first and second ends of an elongated device housing (e.g., ends at regions 22 and 20 of device 10 of FIG. 1), along one or more edges of a device housing, in the center of a device housing, in other suitable locations, or in one or more of these locations. The arrangement of FIG. 1 is merely illustrative.

Portions of peripheral conductive housing structures 12W may be provided with peripheral gap structures. For example, peripheral conductive housing structures 12W may be provided with one or more gaps such as gaps 18, as shown in FIG. 1. The gaps in peripheral conductive housing structures 12W may be filled with dielectric such as polymer, ceramic, glass, air, other dielectric materials, or combinations of these materials. Gaps 18 may divide peripheral conductive housing structures 12W into one or more peripheral conductive segments. The conductive segments that are formed in this way may form parts of antennas in device 10 if desired. Other dielectric openings may be formed in peripheral conductive housing structures 12W (e.g., dielectric openings other than gaps 18) and may serve as dielectric antenna windows for antennas mounted within the interior of device 10. Antennas within device 10 may be aligned with the dielectric antenna windows for conveying radio-frequency signals through peripheral conductive housing structures 12W. Antennas within device 10 may also be aligned with inactive area IA of display 14 for conveying radio-frequency signals through display 14.

In order to provide an end user of device 10 with as large of a display as possible (e.g., to maximize an area of the device used for displaying media, running applications, etc.), it may be desirable to increase the amount of area at the front face of device 10 that is covered by active area AA of display 14. Increasing the size of active area AA may reduce the size of inactive area IA within device 10. This may reduce the area behind display 14 that is available for antennas within device 10. For example, active area AA of display 14 may include conductive structures that serve to block radio-frequency signals handled by antennas mounted behind active area AA from radiating through the front face of device 10. It would therefore be desirable to be able to provide antennas that occupy a small amount of space within device 10 (e.g., to allow for as large of a display active area AA as possible) while still allowing the antennas to communicate with wireless equipment external to device 10 with satisfactory efficiency bandwidth.

In a typical scenario, device 10 may have one or more upper antennas and one or more lower antennas (as an example). An upper antenna may, for example, be formed at the upper end of device 10 in region 20. A lower antenna may, for example, be formed at the lower end of device 10 in region 22. Additional antennas may be formed along the edges of housing 12 extending between regions 20 and 22 if desired. The antennas may be used separately to cover identical communications bands, overlapping communications bands, or separate communications bands. The antennas may be used to implement an antenna diversity scheme or a multiple-input-multiple-output (MIMO) antenna scheme. Other antennas for covering any other desired frequencies may also be mounted at any desired locations within the interior of device 10. The example of FIG. 1 is merely illustrative. If desired, housing 12 may have other shapes (e.g., a square shape, cylindrical shape, spherical shape, combinations of these and/or different shapes, etc.).

Figure 2:
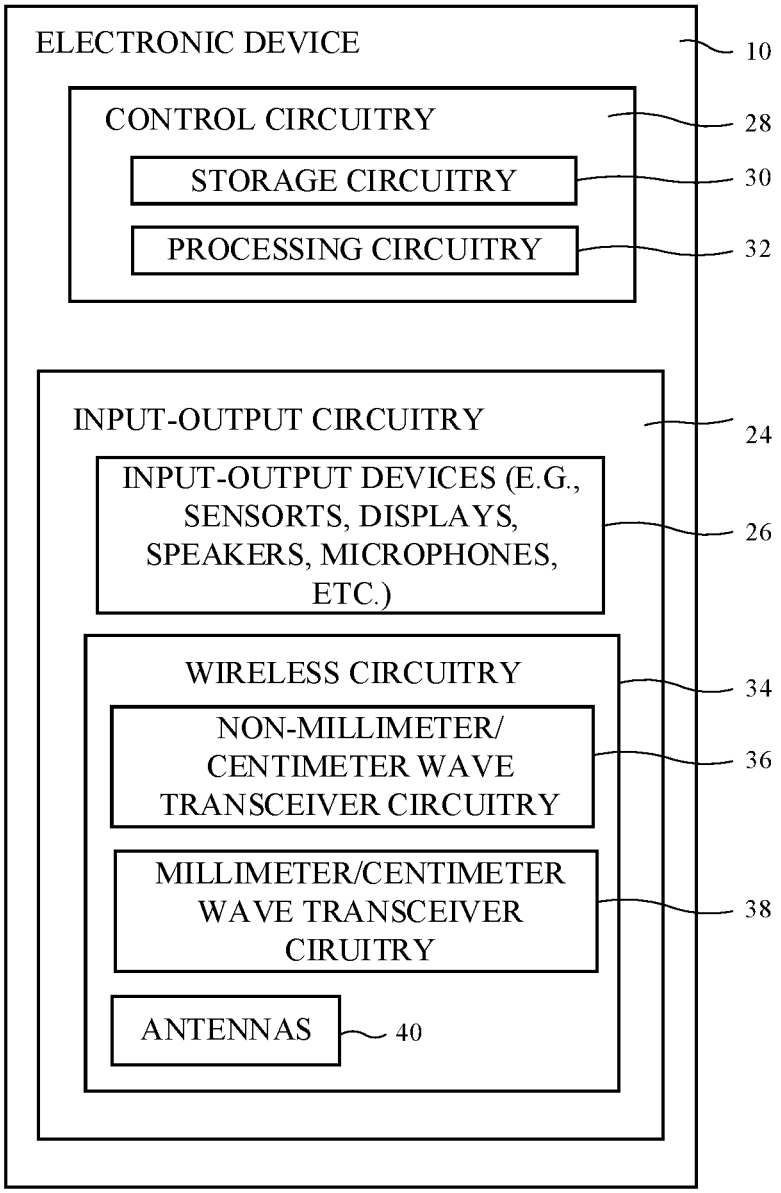
FIG. 2 is a schematic diagram of illustrative circuitry in an electronic device in accordance with some embodiments.

A schematic diagram of illustrative components that may be used in device 10 is shown in FIG. 2. As shown in FIG. 2, device 10 may include control circuitry 28. Control circuitry 28 may include storage such as storage circuitry 30. Storage circuitry 30 may include hard disk drive storage, nonvolatile memory (e.g., flash memory or other electrically-programmable-read-only memory configured to form a solid-state drive), volatile memory (e.g., static or dynamic random-access-memory), etc. Control circuitry 28 may include processing circuitry such as processing circuitry 32. Processing circuitry 32 may be used to control the operation of device 10. Processing circuitry 32 may include on one or more microprocessors, microcontrollers, digital signal processors, host processors, baseband processor integrated circuits, application specific integrated circuits, central processing units (CPUs), etc. Control circuitry 28 may be configured to perform operations in device 10 using hardware (e.g., dedicated hardware or circuitry), firmware, and/or software. Software code for performing operations in device 10 may be stored on storage circuitry 30 (e.g., storage circuitry 30 may include non-transitory (tangible) computer readable storage media that stores the software code). The software code may sometimes be referred to as program instructions, software, data, instructions, or code. Software code stored on storage circuitry 30 may be executed by processing circuitry 32.

Control circuitry 28 may be used to run software on device 10 such as internet browsing applications, voice-over-internet-protocol (VOIP) telephone call applications, email applications, media playback applications, operating system functions, etc. To support interactions with external equipment, control circuitry 28 may be used in implementing communications protocols. Communications protocols that may be implemented using control circuitry 28 include internet protocols, wireless local area network protocols (e.g., IEEE 802.11 protocols—sometimes referred to as WiFi®), protocols for other short-range wireless communications links such as the Bluetooth® protocol or other WPAN protocols, IEEE 802.11ad protocols, cellular telephone protocols, MIMO protocols, antenna diversity protocols, satellite navigation system protocols, antenna-based spatial ranging protocols (e.g., radio detection and ranging (RADAR) protocols or other desired range detection protocols for signals conveyed at millimeter and centimeter wave frequencies), etc. Each communication protocol may be associated with a corresponding radio access technology (RAT) that specifies the physical connection methodology used in implementing the protocol.

Device 10 may include input-output circuitry 24. Input-output circuitry 24 may include input-output devices 26. Input-output devices 26 may be used to allow data to be supplied to device 10 and to allow data to be provided from device 10 to external devices. Input-output devices 26 may include user interface devices, data port devices, sensors, and other input-output components. For example, input-output devices may include touch screens, displays without touch sensor capabilities, buttons, joysticks, scrolling wheels, touch pads, key pads, keyboards, microphones, cameras, speakers, status indicators, light sources, audio jacks and other audio port components, digital data port devices, light sensors, gyroscopes, accelerometers or other components that can detect motion and device orientation relative to the Earth, capacitance sensors, proximity sensors (e.g., a capacitive proximity sensor and/or an infrared proximity sensor), magnetic sensors, and other sensors and input-output components.

Input-output circuitry 24 may include wireless circuitry such as wireless circuitry 34 for wirelessly conveying radio-frequency signals. While control circuitry 28 is shown separately from wireless circuitry 34 in the example of FIG. 2 for the sake of clarity, wireless circuitry 34 may include processing circuitry that forms a part of processing circuitry 32 and/or storage circuitry that forms a part of storage circuitry 30 of control circuitry 28 (e.g., portions of control circuitry 28 may be implemented on wireless circuitry 34). As an example, control circuitry 28 may include baseband processor circuitry or other control components that form a part of wireless circuitry 34.

Wireless circuitry 34 may include millimeter and centimeter wave transceiver circuitry such as millimeter/centimeter wave transceiver circuitry 38. Millimeter/centimeter wave transceiver circuitry 38 may support communications at frequencies between about 10 GHz and 300 GHz. For example, millimeter/centimeter wave transceiver circuitry 38 may support communications in Extremely High Frequency (EHF) or millimeter wave communications bands between about 30 GHz and 300 GHz and/or in centimeter wave communications bands between about 10 GHz and 30 GHz (sometimes referred to as Super High Frequency (SHF) bands). As examples, millimeter/centimeter wave transceiver circuitry 38 may support communications in an IEEE K communications band between about 18 GHz and 27 GHz, a $K_a$ communications band between about 26.5 GHz and 40 GHz, a $K_u$ communications band between about 12 GHz and 18 GHz, a V communications band between about 40 GHz and 75 GHz, a W communications band between about 75 GHz and 110 GHz, or any other desired frequency band between approximately 10 GHz and 300 GHz. If desired, millimeter/centimeter wave transceiver circuitry 38 may support IEEE 802.11ad communications at 60 GHz and/or $5^{th}$ generation mobile networks or $5^{th}$ generation wireless systems (5G) communications bands between 27 GHz and 90 GHz. Millimeter/centimeter wave transceiver circuitry 38 may be formed from one or more integrated circuits (e.g., multiple integrated circuits mounted on a common printed circuit in a system-in-package device, one or more integrated circuits mounted on different substrates, etc.).

If desired, millimeter/centimeter wave transceiver circuitry 38 (sometimes referred to herein simply as transceiver circuitry 38 or millimeter/centimeter wave circuitry 38) may perform spatial ranging operations using radio-frequency signals at millimeter and/or centimeter wave signals that are transmitted and received by millimeter/centimeter wave transceiver circuitry 38. The received signals may be a version of the transmitted signals that have been reflected off of external objects and back towards device 10. Control circuitry 28 may process the transmitted and received signals to detect or estimate a range between device 10 and one or more external objects in the surroundings of device 10 (e.g., objects external to device 10 such as the body of a user or other persons, other devices, animals, furniture, walls, or other objects or obstacles in the vicinity of device 10). If desired, control circuitry 28 may also process the transmitted and received signals to identify a two or three-dimensional spatial location of the external objects relative to device 10.

Spatial ranging operations performed by millimeter/centimeter wave transceiver circuitry 38 are unidirectional. Millimeter/centimeter wave transceiver circuitry 38 may perform bidirectional communications with external wireless equipment. Bidirectional communications involve both the transmission of wireless data by millimeter/centimeter wave transceiver circuitry 38 and the reception of wireless data that has been transmitted by external wireless equipment. The wireless data may, for example, include data that has been encoded into corresponding data packets such as wireless data associated with a telephone call, streaming media content, internet browsing, wireless data associated with software applications running on device 10, email messages, etc.

If desired, wireless circuitry 34 may include transceiver circuitry for handling communications at frequencies below 10 GHz such as non-millimeter/centimeter wave transceiver circuitry 36. Non-millimeter/centimeter wave transceiver circuitry 36 may include wireless local area network (WLAN) transceiver circuitry that handles 2.4 GHz and 5 GHz bands for Wi-Fi® (IEEE 802.11) communications, wireless personal area network (WPAN) transceiver circuitry that handles the 2.4 GHz Bluetooth® communications band, cellular telephone transceiver circuitry that handles cellular telephone communications bands from 700 to 960 MHz, 1710 to 2170 MHz, 2300 to 2700 MHz, and/or or any other desired cellular telephone communications bands between 600 MHz and 4000 MHz, GPS receiver circuitry that receives GPS signals at 1575 MHz or signals for handling other satellite positioning data (e.g., GLONASS signals at 1609 MHz), television receiver circuitry, AM/FM radio receiver circuitry, paging system transceiver circuitry, near field communications (NFC) circuitry, etc. Non-millimeter/centimeter wave transceiver circuitry 36 and millimeter/centimeter wave transceiver circuitry 38 may each include one or more integrated circuits, power amplifier circuitry, low-noise input amplifiers, passive radio-frequency components, switching circuitry, transmission line structures, and other circuitry for handling radio-frequency signals.

Wireless circuitry 34 may include antennas 40. Non-millimeter/centimeter wave transceiver circuitry 36 may transmit and receive radio-frequency signals below 10 GHz using one or more antennas 40. Millimeter/centimeter wave transceiver circuitry 38 may transmit and receive radio-frequency signals above 10 GHz (e.g., at millimeter wave and/or centimeter wave frequencies) using antennas 40. In general, transceiver circuitry 36 and 38 may be configured to cover (handle) any suitable communications (frequency) bands of interest. The transceiver circuitry may convey radio-frequency signals using antennas 40 (e.g., antennas 40 may convey the radio-frequency signals for the transceiver circuitry). The term "convey radio-frequency signals" as used herein means the transmission and/or reception of the radio-frequency signals (e.g., for performing unidirectional and/or bidirectional wireless communications with external wireless communications equipment). Antennas 40 may transmit the radio-frequency signals by radiating the radio-frequency signals into free space (or to freespace through intervening device structures such as a dielectric cover layer). Antennas 40 may additionally or alternatively receive the radio-frequency signals from free space (e.g., through intervening devices structures such as a dielectric cover layer). The transmission and reception of radio-frequency signals by antennas 40 each involve the excitation or resonance of antenna currents on an antenna resonating element in the antenna by the radio-frequency signals within the frequency band(s) of operation of the antenna.

In satellite navigation system links, cellular telephone links, and other long-range links, radio-frequency signals are typically used to convey data over thousands of feet or miles. In Wi-Fi® and Bluetooth® links at 2.4 and 5 GHz and other short-range wireless links, radio-frequency signals are typically used to convey data over tens or hundreds of feet. Millimeter/centimeter wave transceiver circuitry 38 may convey radio-frequency signals over short distances that travel over a line-of-sight path. To enhance signal reception for millimeter and centimeter wave communications, phased antenna arrays and beam steering techniques may be used (e.g., schemes in which antenna signal phase and/or magnitude for each antenna in an array are adjusted to perform beam steering). Antenna diversity schemes may also be used to ensure that the antennas that have become blocked or that are otherwise degraded due to the operating environment of device 10 can be switched out of use and higher-performing antennas used in their place.

Antennas 40 in wireless circuitry 34 may be formed using any suitable antenna types. For example, antennas 40 may include antennas with resonating elements that are formed from stacked patch antenna structures, loop antenna structures, patch antenna structures, inverted-F antenna structures, slot antenna structures, planar inverted-F antenna structures, monopole antenna structures, dipole antenna structures, helical antenna structures, Yagi (Yagi-Uda) antenna structures, hybrids of these designs, etc. In another suitable arrangement, antennas 40 may include antennas with dielectric resonating elements such as dielectric resonator antennas. If desired, one or more of antennas 40 may be cavity-backed antennas. Different types of antennas may be used for different bands and combinations of bands. For example, one type of antenna may be used in forming a non-millimeter/centimeter wave wireless link for non-millimeter/centimeter wave transceiver circuitry 36 and another type of antenna may be used in conveying radio-frequency signals at millimeter and/or centimeter wave frequencies for millimeter/centimeter wave transceiver circuitry 38. Antennas 40 that are used to convey radio-frequency signals at millimeter and centimeter wave frequencies may be arranged in one or more phased antenna arrays.

Figure 3:
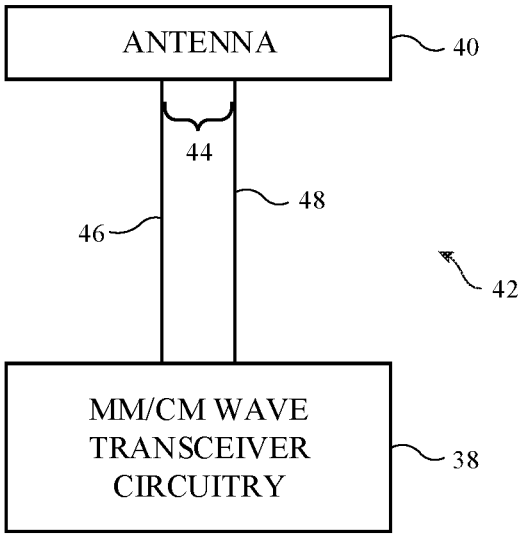
FIG. 3 is a schematic diagram of illustrative wireless circuitry in accordance with some embodiments.

A schematic diagram of an antenna 40 that may be formed in a phased antenna array for conveying radio-frequency signals at millimeter and centimeter wave frequencies is shown in FIG. 3. As shown in FIG. 3, antenna 40 may be coupled to millimeter/centimeter (MM/CM) wave transceiver circuitry 38. Millimeter/centimeter wave transceiver circuitry 38 may be coupled to antenna feed 44 of antenna 40 using a transmission line path that includes radio-frequency transmission line 42. Radio-frequency transmission line 42 may include a positive signal conductor such as signal conductor 46 and may include a ground conductor such as ground conductor 48. Ground conductor 48 may be coupled to the antenna ground for antenna 40 (e.g., over a ground antenna feed terminal of antenna feed 44 located on the antenna ground). Signal conductor 46 may be coupled to the antenna resonating element for antenna 40. For example, signal conductor 46 may be coupled to a positive antenna feed terminal of antenna feed 44 located on the antenna resonating element. In another suitable arrangement, antenna 40 may be a probe-fed antenna that is fed using a feed probe. In this arrangement, antenna feed 44 may be implemented as a feed probe. Signal conductor 46 may be coupled to the feed probe. Radio-frequency transmission line 42 may convey radio-frequency signals to and from the feed probe. When radio-frequency signals are being conveyed over the feed probe, the feed probe may excite the resonating element for the antenna (e.g., a dielectric antenna resonating element for antenna 40). The resonating element may radiate the radio-frequency signals in response to excitation by the feed probe.

Radio-frequency transmission line 42 may include a stripline transmission line (sometimes referred to herein simply as a stripline), a coaxial cable, a coaxial probe realized by metalized vias, a microstrip transmission line, an edge-coupled microstrip transmission line, an edge-coupled stripline transmission lines, a waveguide structure, combinations of these, etc. Multiple types of transmission lines may be used to form the transmission line path that couples millimeter/centimeter wave transceiver circuitry 38 to antenna feed 44. Filter circuitry, switching circuitry, impedance matching circuitry, phase shifter circuitry, amplifier circuitry, and/or other circuitry may be interposed on radio-frequency transmission line 42, if desired.

Radio-frequency transmission lines in device 10 may be integrated into ceramic substrates, rigid printed circuit boards, and/or flexible printed circuits. In one suitable arrangement, radio-frequency transmission lines in device 10 may be integrated within multilayer laminated structures (e.g., layers of a conductive material such as copper and a dielectric material such as a resin that are laminated together without intervening adhesive) that may be folded or bent in multiple dimensions (e.g., two or three dimensions) and that maintain a bent or folded shape after bending (e.g., the multilayer laminated structures may be folded into a particular three-dimensional shape to route around other device components and may be rigid enough to hold its shape after folding without being held in place by stiffeners or other structures). All of the multiple layers of the laminated structures may be batch laminated together (e.g., in a single pressing process) without adhesive (e.g., as opposed to performing multiple pressing processes to laminate multiple layers together with adhesive).

Figure 4:
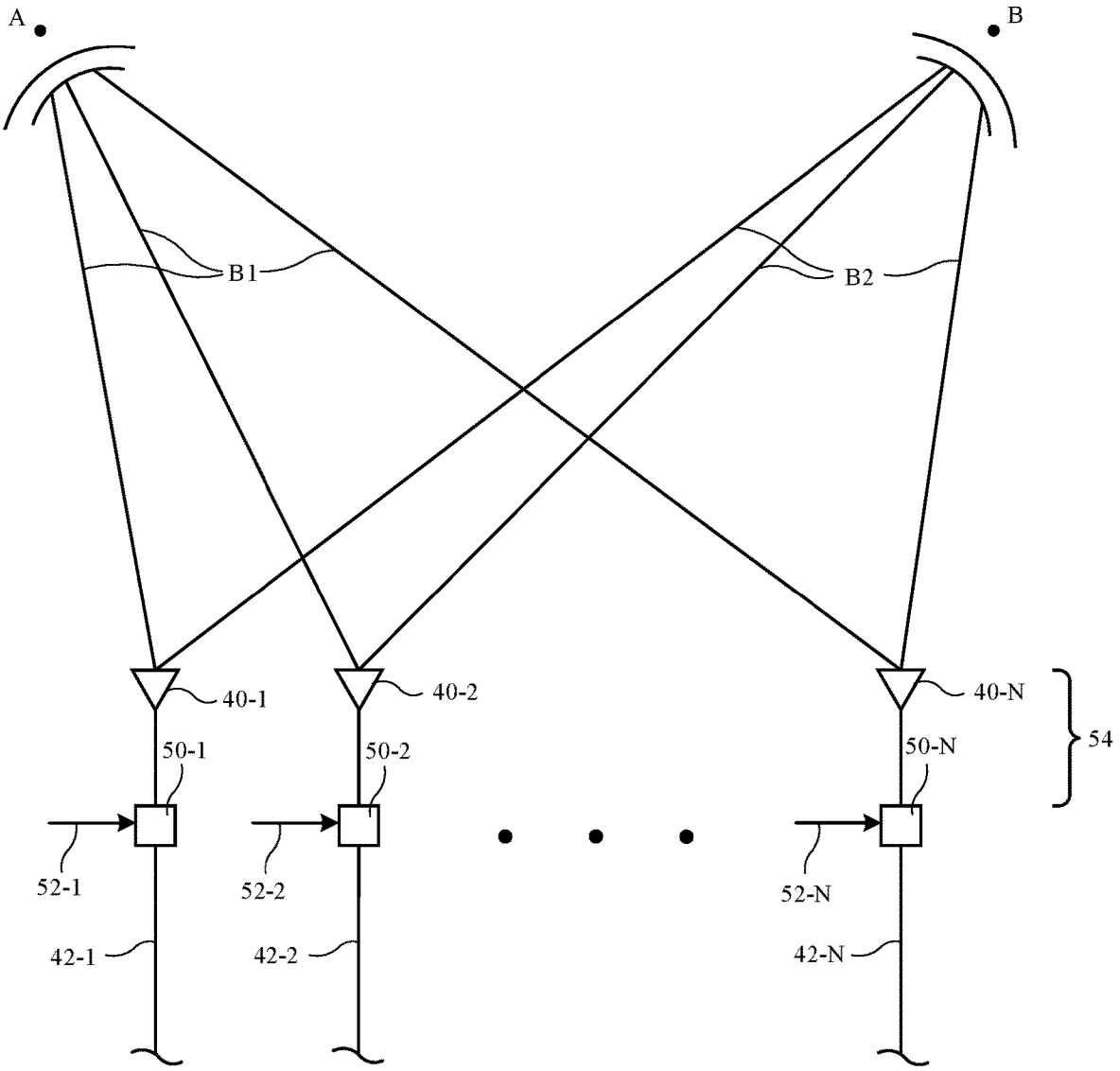
FIG. 4 is a diagram of an illustrative phased antenna array that may be adjusted using control circuitry to direct a beam of signals in accordance with some embodiments.

FIG. 4 shows how antennas 40 for handling radio-frequency signals at millimeter and centimeter wave frequencies may be formed in a phased antenna array. As shown in FIG. 4, phased antenna array 54 (sometimes referred to herein as array 54, antenna array 54, or array 54 of antennas 40) may be coupled to radio-frequency transmission lines 42. For example, a first antenna 40-1 in phased antenna array 54 may be coupled to a first radio-frequency transmission line 42-1, a second antenna 40-2 in phased antenna array 54 may be coupled to a second radio-frequency transmission line 42-2, an Nth antenna 40-N in phased antenna array 54 may be coupled to an Nth radio-frequency transmission line 42-N, etc. While antennas 40 are described herein as forming a phased antenna array, the antennas 40 in phased antenna array 54 may sometimes also be referred to as collectively forming a single phased array antenna.

Antennas 40 in phased antenna array 54 may be arranged in any desired number of rows and columns or in any other desired pattern (e.g., the antennas need not be arranged in a grid pattern having rows and columns). During signal transmission operations, radio-frequency transmission lines 42 may be used to supply signals (e.g., radio-frequency signals such as millimeter wave and/or centimeter wave signals) from millimeter/centimeter wave transceiver circuitry 38 (FIG. 3) to phased antenna array 54 for wireless transmission. During signal reception operations, radio-frequency transmission lines 42 may be used to convey signals received at phased antenna array 54 (e.g., from external wireless equipment or transmitted signals that have been reflected off of external objects) to millimeter/centimeter wave transceiver circuitry 38 (FIG. 3).

The use of multiple antennas 40 in phased antenna array 54 allows beam steering arrangements to be implemented by controlling the relative phases and magnitudes (amplitudes) of the radio-frequency signals conveyed by the antennas. In the example of FIG. 4, antennas 40 each have a corresponding radio-frequency phase and magnitude controller 50 (e.g., a first phase and magnitude controller 50-1 interposed on radio-frequency transmission line 42-1 may control phase and magnitude for radio-frequency signals handled by antenna 40-1, a second phase and magnitude controller 50-2 interposed on radio-frequency transmission line 42-2 may control phase and magnitude for radio-frequency signals handled by antenna 40-2, an Nth phase and magnitude controller 50-N interposed on radio-frequency transmission line 42-N may control phase and magnitude for radio-frequency signals handled by antenna 40-N, etc.).

Phase and magnitude controllers 50 may each include circuitry for adjusting the phase of the radio-frequency signals on radio-frequency transmission lines 42 (e.g., phase shifter circuits) and/or circuitry for adjusting the magnitude of the radio-frequency signals on radio-frequency transmission lines 42 (e.g., power amplifier and/or low noise amplifier circuits). Phase and magnitude controllers 50 may sometimes be referred to collectively herein as beam steering circuitry (e.g., beam steering circuitry that steers the beam of radio-frequency signals transmitted and/or received by phased antenna array 54).

Phase and magnitude controllers 50 may adjust the relative phases and/or magnitudes of the transmitted signals that are provided to each of the antennas in phased antenna array 54 and may adjust the relative phases and/or magnitudes of the received signals that are received by phased antenna array 54. Phase and magnitude controllers 50 may, if desired, include phase detection circuitry for detecting the phases of the received signals that are received by phased antenna array 54. The term "beam" or "signal beam" may be used herein to collectively refer to wireless signals that are transmitted and received by phased antenna array 54 in a particular direction. The signal beam may exhibit a peak gain that is oriented in a particular pointing direction at a corresponding pointing angle (e.g., based on constructive and destructive interference from the combination of signals from each antenna in the phased antenna array). The term "transmit beam" may sometimes be used herein to refer to radio-frequency signals that are transmitted in a particular direction whereas the term "receive beam" may sometimes be used herein to refer to radio-frequency signals that are received from a particular direction.

If, for example, phase and magnitude controllers 50 are adjusted to produce a first set of phases and/or magnitudes for transmitted radio-frequency signals, the transmitted signals will form a transmit beam as shown by beam B1 of FIG. 4 that is oriented in the direction of point A. If, however, phase and magnitude controllers 50 are adjusted to produce a second set of phases and/or magnitudes for the transmitted signals, the transmitted signals will form a transmit beam as shown by beam B2 that is oriented in the direction of point B. Similarly, if phase and magnitude controllers 50 are adjusted to produce the first set of phases and/or magnitudes, radio-frequency signals (e.g., radio-frequency signals in a receive beam) may be received from the direction of point A, as shown by beam B1. If phase and magnitude controllers 50 are adjusted to produce the second set of phases and/or magnitudes, radio-frequency signals may be received from the direction of point B, as shown by beam B2.

Each phase and magnitude controller 50 may be controlled to produce a desired phase and/or magnitude based on a corresponding control signal 52 received from control circuitry 28 of FIG. 2 (e.g., the phase and/or magnitude provided by phase and magnitude controller 50-1 may be controlled using control signal 52-1, the phase and/or magnitude provided by phase and magnitude controller 50-2 may be controlled using control signal 52-2, etc.). If desired, the control circuitry may actively adjust control signals 52 in real time to steer the transmit or receive beam in different desired directions over time. Phase and magnitude controllers 50 may provide information identifying the phase of received signals to control circuitry 28 if desired.

When performing wireless communications using radio-frequency signals at millimeter and centimeter wave frequencies, the radio-frequency signals are conveyed over a line of sight path between phased antenna array 54 and external communications equipment. If the external object is located at point A of FIG. 4, phase and magnitude controllers 50 may be adjusted to steer the signal beam towards point A (e.g., to steer the pointing direction of the signal beam towards point A). Phased antenna array 54 may transmit and receive radio-frequency signals in the direction of point A. Similarly, if the external communications equipment is located at point B, phase and magnitude controllers 50 may be adjusted to steer the signal beam towards point B (e.g., to steer the pointing direction of the signal beam towards point B). Phased antenna array 54 may transmit and receive radio-frequency signals in the direction of point B. In the example of FIG. 4, beam steering is shown as being performed over a single degree of freedom for the sake of simplicity (e.g., towards the left and right on the page of FIG. 4). However, in practice, the beam may be steered over two or more degrees of freedom (e.g., in three dimensions, into and out of the page and to the left and right on the page of FIG. 4). Phased antenna array 54 may have a corresponding field of view over which beam steering can be performed (e.g., in a hemisphere or a segment of a hemisphere over the phased antenna array). If desired, device 10 may include multiple phased antenna arrays that each face a different direction to provide coverage from multiple sides of the device.

Figure 5:
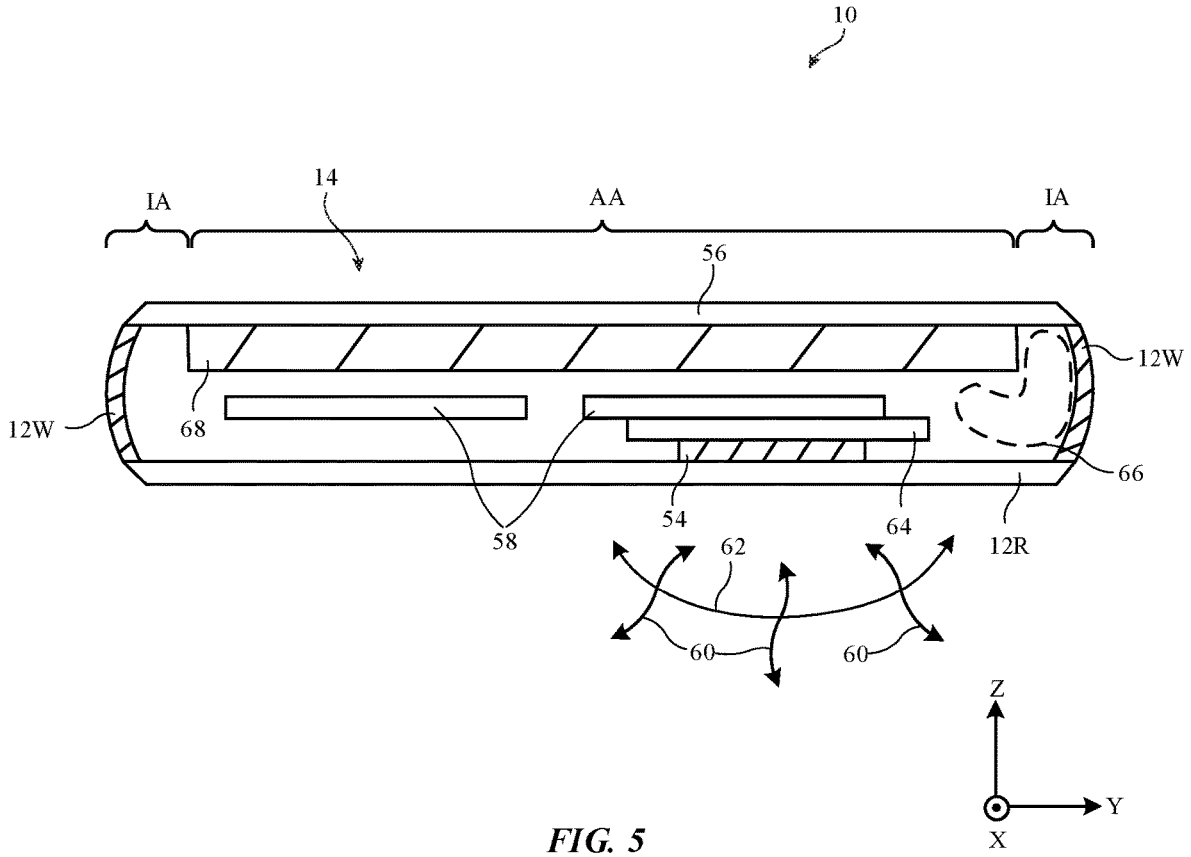
FIG. 5 is a cross-sectional side view of an illustrative electronic device having phased antenna arrays for radiating through different sides of the device in accordance with some embodiments.

FIG. 5 is a cross-sectional side view of device 10 in an example where device 10 has multiple phased antenna arrays. As shown in FIG. 5, peripheral conductive housing structures 12W may extend around the (lateral) periphery of device 10 and may extend from rear housing wall 12R to display 14. Display 14 may have a display module such as display module 68 (sometimes referred to as a display panel). Display module 68 may include pixel circuitry, touch sensor circuitry, force sensor circuitry, and/or any other desired circuitry for forming active area AA of display 14. Display 14 may include a dielectric cover layer such as display cover layer 56 that overlaps display module 68. Display module 68 may emit image light and may receive sensor input through display cover layer 56. Display cover layer 56 and display 14 may be mounted to peripheral conductive housing structures 12W. The lateral area of display 14 that does not overlap display module 68 may form inactive area IA of display 14.

Device 10 may include multiple phased antenna arrays 54 such as a rear-facing phased antenna array 54. As shown in FIG. 5, phased antenna array 54 may transmit and receive radio-frequency signals 60 at millimeter and centimeter wave frequencies through rear housing wall 12R. In scenarios where rear housing wall 12R includes metal portions, radio-frequency signals 60 may be conveyed through an aperture or opening in the metal portions of rear housing wall 12R or may be conveyed through other dielectric portions of rear housing wall 12R. The aperture may be overlapped by a dielectric cover layer or dielectric coating that extends across the lateral area of rear housing wall 12R (e.g., between peripheral conductive housing structures 12W). Phased antenna array 54 may perform beam steering for radio-frequency signals 60 across the hemisphere below device 10, as shown by arrow 62.

Phased antenna array 54 may be mounted to support structures such as support structures 64. Phased antenna array 54 may be adhered to rear housing wall 12R using adhesive, may be pressed against (e.g., in contact with) rear housing wall 12R, or may be spaced apart from rear housing wall 12R.

The field of view of phased antenna array 54 is limited to the hemisphere under the rear face of device 10. Display module 68 and other components 58 (e.g., portions of input-output circuitry 24 or control circuitry 28 of FIG. 2, a battery for device 10, etc.) in device 10 include conductive structures. If care is not taken, these conductive structures may block radio-frequency signals from being conveyed by a phased antenna array within device 10 across the hemisphere over the front face of device 10. While an additional phased antenna array for covering the hemisphere over the front face of device 10 may be mounted against display cover layer 56 within inactive area IA, there may be insufficient space between the lateral periphery of display module 68 and peripheral conductive housing structures 12W to form all of the circuitry and radio-frequency transmission lines necessary to fully support the phased antenna array. In order to mitigate these issues and provide coverage through the front face of device 10, a front-facing phased antenna array may be mounted within peripheral region 66 of device 10. The antennas in the front-facing phased antenna array may include dielectric resonator antennas in one suitable arrangement. Dielectric resonator antennas may occupy less area in the X-Y plane of FIG. 5 than other types of antennas such as patch antennas and slot antennas. Implementing the antennas as dielectric resonator antennas may allow the radiating elements of the front-facing phased antenna array to fit within inactive area IA between display module 68 and peripheral conductive housing structures 12W. At the same time, the radio-frequency transmission lines and other components for the phased antenna array may be located behind (under) display module 68.

In practice, it can be difficult to form phased antenna array 54 on support structures 64 without occupying excessive space within device 10 and while still exhibiting satisfactory performance. In some scenarios, the front end circuitry for phased antenna array 54 and the antennas in phased antenna array 54 may be integrated into a standalone antenna module (e.g., support structures 64 of FIG. 5 may be a standalone antenna module).

Figure 6:
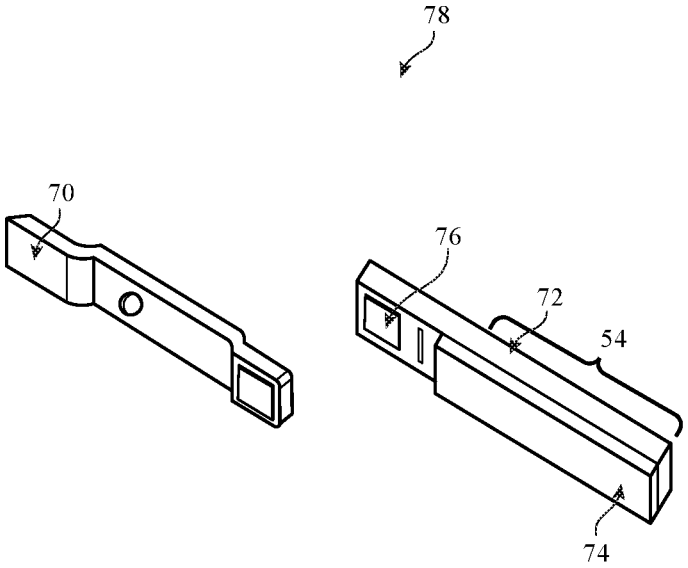
FIG. 6 is a perspective view of a standalone antenna module in accordance with some embodiments.

FIG. 6 is a perspective view of a standalone antenna module that may be used for implementing phased antenna array 54 (e.g., for radiating through rear housing wall 12R, for radiating through display cover layer 56, or for radiating through other portions of device 10). As shown in FIG. 6, phased antenna array 54 may be integrated into a standalone antenna module 78.

Standalone antenna module 78 may include multi-layered printed circuit board 72 (e.g., multiple stacked layers of dielectric printed circuit board material, ceramic, etc.). The antennas 40 in phased antenna array 54 may be patterned on multi-layered printed circuit board 72, which also includes the transmission lines used to feed the antennas 40 (e.g., radio-frequency transmission lines 42 of FIG. 4). Connector 76 may be mounted to multi-layered printed circuit board 72. External flexible printed circuit 70 may be connected to connector 76. External flexible printed circuit 70 may convey intermediate frequency signals (e.g., signals at frequencies greater than baseband but lower than the signals of the radio-frequency signals radiated by phased antenna array 54), control signals, and power signals for phased antenna array 54 (e.g., signals that are conveyed to standalone antenna module 78 through connector 76).

Standalone antenna module 78 may also include shielded components 74. Shielded components 74 may include a radio-frequency integrated circuit, phase and magnitude controllers 50 of FIG. 4, passive circuitry (e.g., tuning circuitry, impedance matching circuitry etc.), amplifiers, switches, and/or any other desired radio-frequency front end circuitry for supporting radio-frequency communications using phased antenna array 54.

Integrating radio-frequency front end circuitry for phased antenna array 54 and the antennas of phased antenna array 54 into the same standalone antenna module such as standalone antenna module 78 of FIG. 6 can consume an excessive amount of space within device 10. In order to more efficiently utilize space in implementing phased antenna array 54, phased antenna array 54 may be formed in a logic-board-integrated antenna module.

Figure 7:
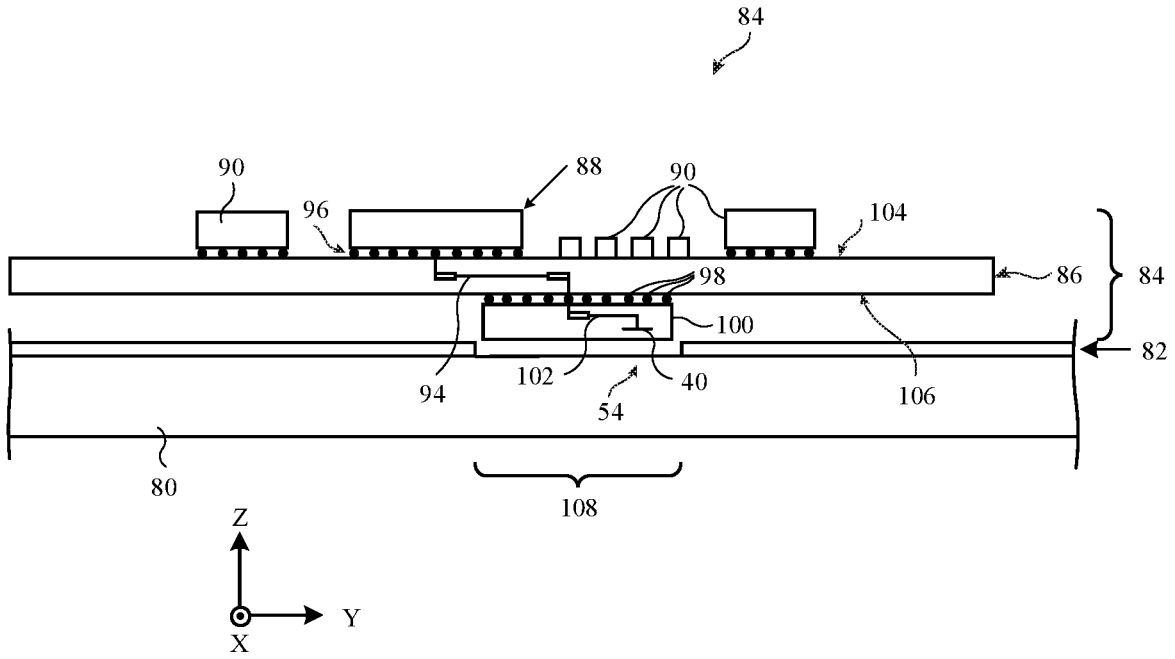
FIG. 7 is a cross-sectional side view of an illustrative logic-board-integrated antenna module formed from a radio-frequency integrated circuit and an antenna board mounted to a logic board in accordance with some embodiments.

FIG. 7 is a cross-sectional side view showing how phased antenna array 54 may be formed in a logic-board-integrated antenna module. As shown in FIG. 7, the antennas 40 in phased antenna array 54 may be formed on a substrate such as antenna board 100. Only a single antenna 40 is shown in FIG. 7 for the sake of clarity but, in general, phased antenna array 54 may include any desired number of antennas 40.

Antenna board 100 may be a multi-layered printed circuit board (e.g., a printed circuit board having multiple stacked layers of dielectric substrate such as multiple stacked layers of printed circuit board material or ceramic). The ground plane and antenna resonating elements (e.g., patch antenna resonating elements in scenarios where antennas 40 are patch antennas) for the antennas 40 in phased antenna array 54 may be patterned on different layers of antenna board 100. In scenarios where antennas 40 are patch antennas, antennas 40 may be stacked patch antennas having multiple vertically stacked patch elements on antenna board 100 (e.g., overlapping directly fed patches and/or parasitic patches).

Impedance-controlled transmission line paths 102 (e.g., transmission line paths including radio-frequency transmission lines 42 of FIG. 4) may be patterned on the layers of antenna board 100. Impedance-controlled transmission line paths 102 may include microstrip transmission lines, stripline transmission lines, conductive vias, etc. Impedance-controlled transmission line paths 102 may have segments with different widths, transmission line stubs, or other structures to help perform impedance matching for phased antenna array 54.

The radio-frequency front end circuitry for phased antenna array 54 (e.g., phase and magnitude controllers 50 of FIG. 4, amplifier circuitry, passive components, etc.) may be offloaded onto radio-frequency integrated circuit (RFIC) 88 (e.g., rather than being formed on the same board as antennas 40 as in standalone antenna module 78 of FIG. 6). RFIC 88 may be an integrated circuit (chip), an integrated circuit package, a system in package (SIP), or any other desired substrate that includes the radio-frequency front end circuitry for phased antenna array 54.

As shown in FIG. 7, antenna board 100 may be mounted to bottom surface 106 of logic board 86 (e.g., a rigid or flexible printed circuit board or other substrate). Logic board 86 may, for example, be the main logic board of device 10. Logic board 86 may therefore also be used to mount additional components 90 for device 10 (e.g., at top surface 104 and/or bottom surface 106). Additional components 90 may include any desired components from control circuitry 28 and input-output circuitry 24 of FIG. 2, a battery for device 10, etc. In one suitable arrangement, antenna board 100 may be mounted to logic board 86 using a surface mount technology (SMT). For example, antenna board 100 may be soldered to contact pads on bottom surface 106 of logic board 86 (e.g., using conductive interconnect structures 98 which may be solder balls, a ball grid array, conductive pins, etc.).

RFIC 88 may be mounted to top surface 104 of logic board 86. In one suitable arrangement, RFIC 88 may be mounted to logic board 86 using a surface mount technology (SMT). For example, RFIC 88 may be soldered to contact pads on top surface 104 of logic board 86 (e.g., using conductive interconnect structures 96 which may be solder balls, a ball grid array, conductive pins, etc.).

As shown in FIG. 7, logic board 86 may include impedance-controlled transmission line paths 94. Impedance-controlled transmission line paths 94 may include microstrip transmission lines, stripline transmission lines, conductive vias, etc. Impedance-controlled transmission line paths 94 may have segments with different widths, transmission line stubs, or other structures to help perform impedance matching for phased antenna array 54. Impedance-controlled transmission line paths 94 may couple the radio-frequency front end circuitry (e.g., phase and magnitude controllers 50 of FIG. 4) in RFIC 88 to the antennas 40 in phased antenna array 54 (e.g., via conductive interconnect structures 96 and 98 and impedance-controlled transmission line paths 102 in antenna board 100). In this way, logic board 86 may serve as an interface between RFIC 88 and antenna board 100 to allow the components of phased antenna array 54 to be distributed between RFIC 88 and antenna board 100 on opposing sides of logic board 86 (e.g., where the phase and magnitude controllers for phased antenna array 54 are formed on RFIC 88 and the antennas 40 for phased antenna array 54 are formed on antenna board 100). RFIC 88, logic board 86, and antenna board 100 may therefore sometimes be referred to collectively herein as logic-board-integrated antenna module 84. The example of FIG. 7 is merely illustrative and, if desired, RFIC 88 may be mounted at other locations on top surface 104, on bottom surface 106, etc.

As shown in FIG. 7, device 10 may have a dielectric cover layer 80. Phased antenna array 54 may radiate through dielectric cover layer 80. Dielectric cover layer 80 may form part of display cover layer 56 or rear housing wall 12R of FIG. 5 or other portions of device 10. If desired, device 10 may include a conductive support plate 82 layered over dielectric cover layer 80 (e.g., dielectric cover layer 80 and conductive support plate 82 may collectively form rear housing wall 12R of FIG. 5). Conductive support plate 82 may provide structural support for device 10 and may form part of an antenna ground, for example. Conductive support plate 82 may have an opening 108 (sometimes referred to herein as slot 108, gap 108, or aperture 108). Antenna board 100 may be aligned with opening 108 to allow phased antenna array 54 to radiate through opening 108 and dielectric cover layer 80. Dielectric cover layer 80 may include glass, plastic, sapphire, or other materials. Conductive support plate 82 may be omitted if desired.

By integrating phased antenna array 54 into logic-board-integrated antenna module 84, phased antenna array 54 may be implemented on device 10 while occupying less space than in scenarios where standalone antenna module 78 of FIG. 6 is used. Phased antenna array 54 may also convey radio-frequency signals without requiring bulky external connectors or interconnects (e.g., connector 76 and external flexible printed circuit 70 of FIG. 6). In addition, forming phased antenna array 54 in logic-board-integrated antenna module 84 may also improve thermal performance relative to standalone module 78 of FIG. 6 (e.g., heat may be more easily dissipated).

Figure 8:
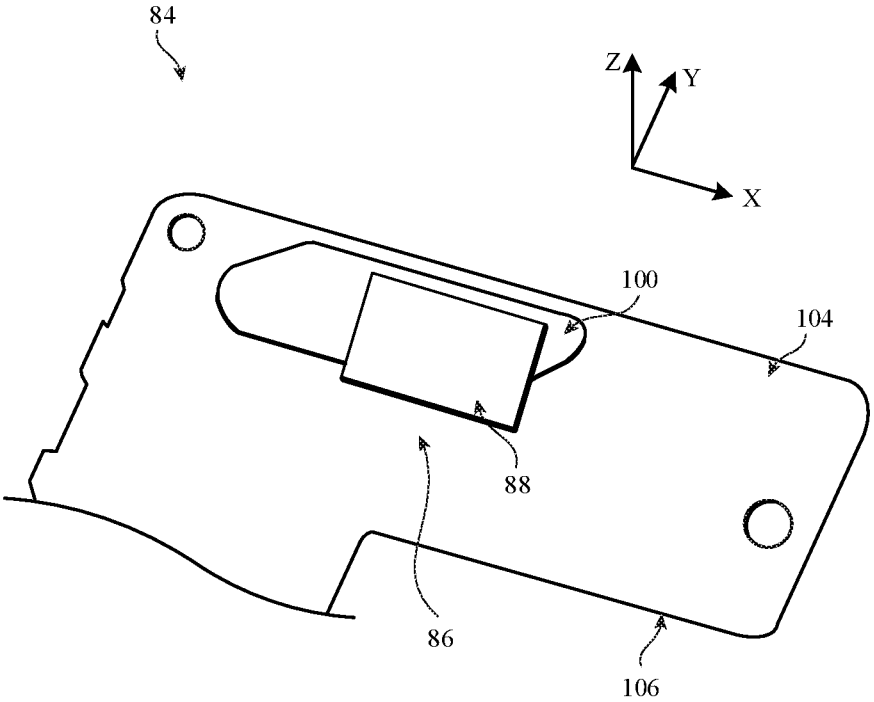
FIG. 8 is a perspective view of an illustrative logic-board-integrated antenna module in accordance with some embodiments.

FIG. 8 is a perspective view of logic-board-integrated antenna module 84 in one suitable example. As shown in FIG. 8, RFIC 88 may be mounted to top surface 104 of logic board 86. Antenna board 100 may be mounted to bottom surface 106 of logic board 86 (logic board 86 is illustrated in transparency in FIG. 8 to show antenna board 100 coupled to bottom surface 106). In general, RFIC 88 may be located in the vicinity of antenna board 100 to minimize routing complexity and inductive losses for impedance-controlled transmission line paths 94 of FIG. 7. RFIC 88 may, for example, partially or completely overlap the lateral outline of antenna board 100 (e.g., in the X-Y plane) or may be non-overlapping with antenna board 100. Logic board 86, RFIC 88, and antenna board 100 of FIG. 8 may have other shapes. The intermediate frequency signals, power signals, and control signals that were otherwise routed by external flexible printed circuit 70 and connector 76 of FIG. 6 may be routed by logic board 86 of FIG. 7 in interfacing between RFIC 88 and antenna board 100.

Figure 9:
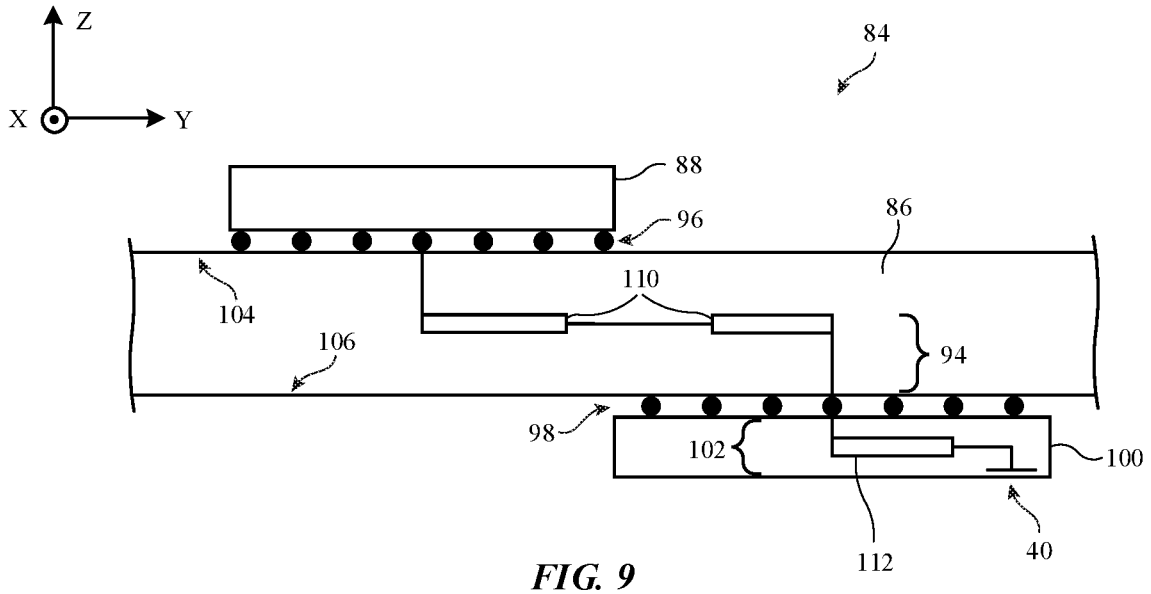
FIG. 9 is a cross-sectional side view showing how a radio-frequency integrated circuit may be laterally offset with respect to an antenna board in a logic-board-integrated antenna module in accordance with some embodiments.

FIG. 9 is a cross-sectional side view showing how RFIC 88 may be laterally offset with respect to antenna board 100 in logic-board-integrated antenna module 84. As shown in FIG. 9, RFIC 88 may be laterally offset (e.g., in the Y-dimension) with respect to antenna board 100. This may allow further optimization of space within device 10 (e.g., RFIC 88 may be laterally offset to accommodate the presence of other components in the vicinity of antenna board 100, antenna board 100 may be laterally offset to allow for more flexible placement of the phased antenna array at a location that can radiate through dielectric cover layer 80 of FIG. 7, etc.). Impedance-controlled transmission line paths 94 in logic board 86 may include one or more optional impedance matching segments 110. Matching segments 110 may be interposed on impedance-controlled transmission line paths 94 at or after each external interface of logic board 86 (e.g., at conductive vias coupled to interconnect structures 96 and 98) to help ensure that impedance is sufficiently matched along the entire transmission line path from the radio-frequency front end components on RFIC 88 to antennas 40. In other words, matching segments 110 may include a first matching segment at conductive interconnect structures 96 (e.g., at the conductive via coupling impedance-controlled transmission line path 94 to a given solder ball in conductive interconnect structures 96) and a second matching segment at conductive interconnect structures 98 (e.g., at the conductive via coupling impedance-controlled transmission line path 94 to a given solder ball in conductive interconnect structures 98). Similarly, impedance-controlled transmission line paths 102 on antenna board 100 may include impedance matching segments 112 at conductive vias coupled to interconnect structures 98 to help ensure that antennas 40 are impedance matched to the transmission lines in logic board 86 and RFIC 88 despite the presence of interconnect structures 98 and 96. This may, for example, minimize losses associated with any potential impedance discontinuities due to the presence of conductive interconnect structures 96 and 98 in implementing logic-board-integrated antenna module 84. This may also configure phased antenna array 54 to operate with optimized bandwidth.

Figure 10:
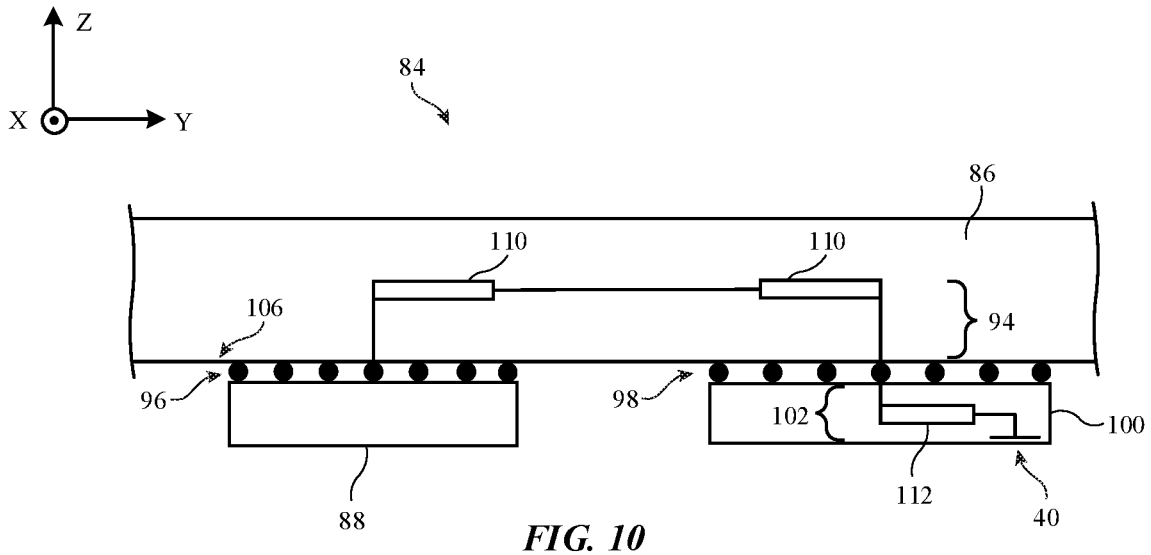
FIG. 10 is a cross-sectional side view showing how a radio-frequency integrated circuit may be formed on the same side of a logic-board-integrated antenna module as an antenna board in accordance with some embodiments.

FIG. 10 is a cross-sectional side view showing how RFIC 88 and antenna board 100 may both be mounted to the same side of logic board 86. As shown in FIG. 10, RFIC 88 and antenna board 100 may both be mounted (e.g., soldered using respective conductive interconnect structures 96 and 98) to bottom surface 106 of logic board 86. Matching segments 110 and 112 may still be used to ensure that impedance is matched along the entire transmission line path from RFIC 88 to antenna 40.

Figure 11:
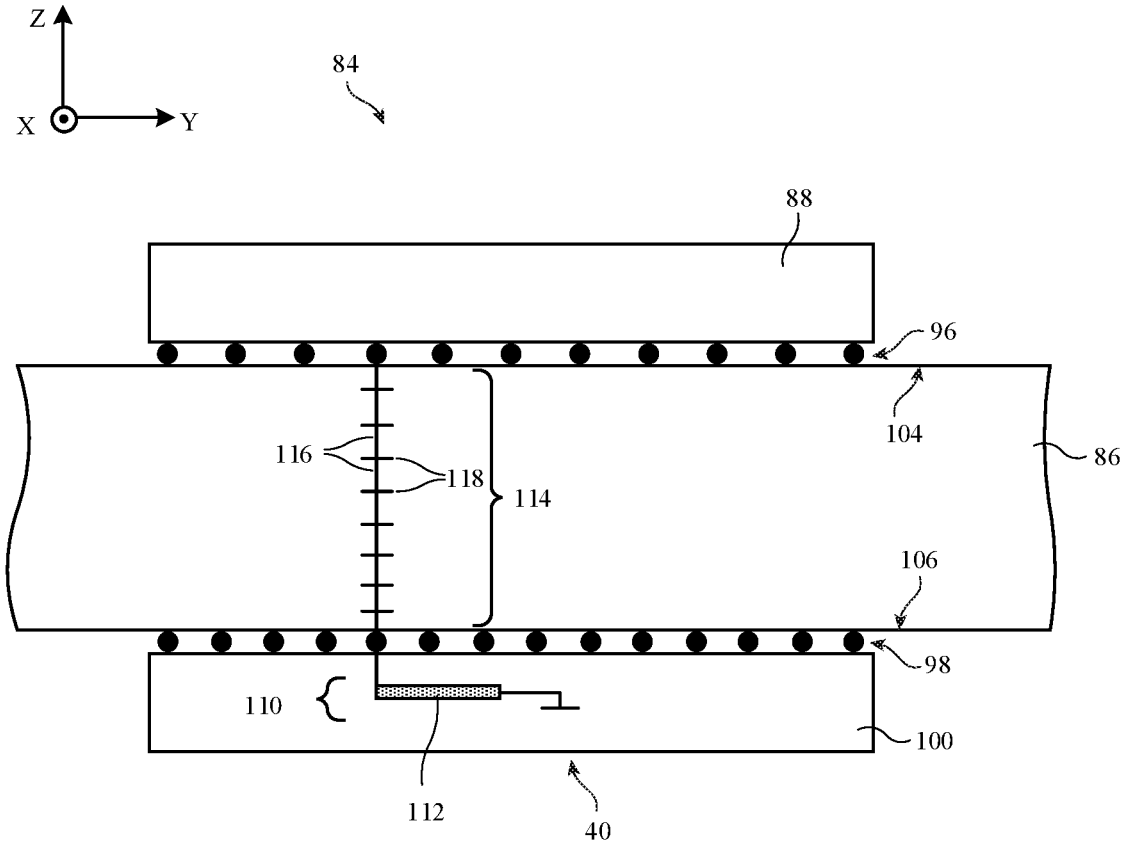
FIG. 11 is a cross-sectional side view showing how a vertical passthrough may be used to couple a radio-frequency integrated circuit to an antenna board in a logic-board-integrated antenna module in accordance with some embodiments.

FIG. 11 is a cross-sectional side view showing how logic board 86 may include a vertical passthrough for coupling RFIC 88 to antenna board 100. As shown in FIG. 11, RFIC 88 may be mounted to top surface 104 and antenna board 100 may be mounted to bottom surface 106 of logic board 86. RFIC 88 may at least partially overlap antenna board 100. Rather than using impedance-controlled transmission line paths 94, logic board 86 may include a vertical passthrough 114 (sometimes referred to herein as vertical path 114) that extends from conductive interconnect structures 96 to conductive interconnect structures 98. Vertical passthrough 114 may include conductive vias 116 coupled to (e.g., in series with) conductive (landing) pads 118, as the conductive vias 116 extend from conductive interconnect structures 96 to conductive interconnect structures 98. When arranged in this way, logic board 86 (e.g., ground traces in logic board 86) may provide ground shielding for isolation and impedance control. Matching segment 112 antenna board 100 can be used to compensate for the impedance transition through the stack up (e.g., to ensure that impedance is matched from RFIC 88 to antenna 40 despite the absence of impedance-controlled transmission line paths 94 and matching segments 110 in logic board 86). Impedance matching segments 110 and 112 of FIGS. 9-11 may, for example, be single-stage segments (e.g., quarter-wavelength transformers). If desired, impedance matching segments 110 and 112 may be multi-stage segments to allow for wider bandwidth or improved matching at their input and output.

Figure 12:
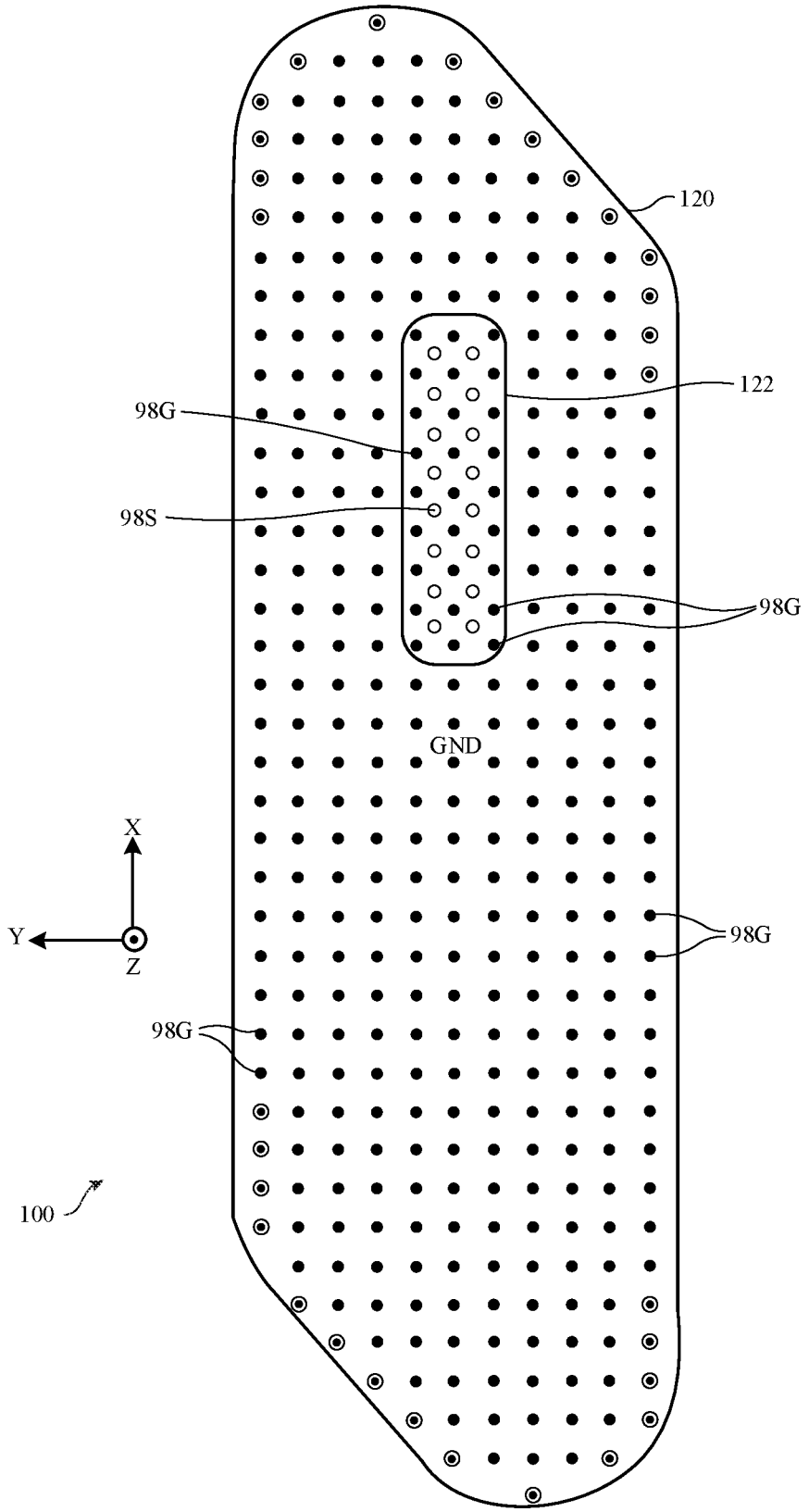
FIG. 12 is a top-down view of an illustrative antenna board in a logic-board-integrated antenna module in accordance with some embodiments.

FIG. 12 is a top-down view of an illustrative layout for antenna board 100 in one suitable arrangement. As shown in FIG. 12, antenna board 100 may include a ground (GND) layer 120 on a top surface of the underlying dielectric layers (e.g., conductive traces held at a ground potential and sometimes referred to herein as ground traces 120). Conductive interconnect structures 98 for antenna board 100 (FIGS. 7-11) may include ground interconnect structures 98G (e.g., solder balls or bumps sometimes referred to herein as ground solder balls 98G) and signal interconnect structures 98S (e.g., solder balls or bumps sometimes referred to herein as signal solder balls 98S).

Ground layer 120 may be coupled to ground traces on logic board 86 using ground interconnect structures 98G. Ground layer 120 may have openings aligned with signal interconnect structures 98S. Signal interconnect structures 98S may be coupled to the impedance-controlled transmission line paths 102 in antenna board 100 (FIGS. 7 and 9-11). When antenna board 100 is mounted to logic board 86, signal interconnect structures 98S may be coupled to the impedance-controlled transmission line paths 94 in logic board 86 (or vertical passthrough 114 in the arrangement of FIG. 11). The ground interconnect structures 98G within ring 122 may, for example, shield signal interconnect structures 98S and/or provide impedance control. The example of FIG. 12 is merely illustrative and, if desired, signal interconnect structures 98S may be provided in other patterns. Antenna board 100 may have other shapes.

Figure 13:
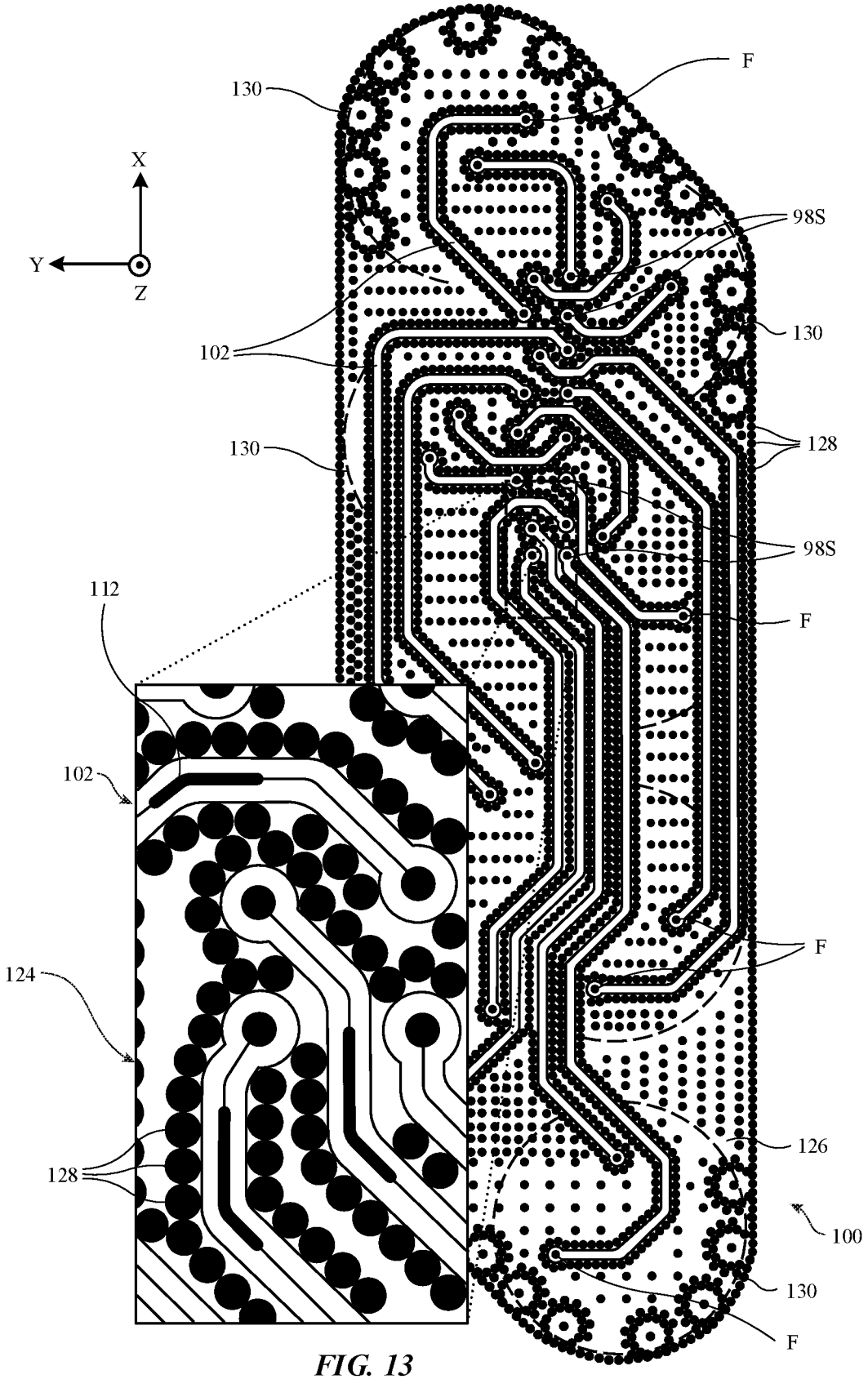
FIG. 13 is a top-down view of illustrative impedance-controlled transmission lines in an antenna board of a logic-board-integrated antenna module in accordance with some embodiments.

FIG. 13 is a top-down view of antenna board 100 of FIG. 12, but where ground layer 120 of FIG. 12 has been removed to reveal the underlying impedance-controlled transmission line paths 102 in antenna board 100. As shown in FIG. 13, antenna board 100 may include additional ground traces 126 (e.g., ground traces vertically interposed between ground layer 120 of FIG. 12 and the antenna resonating elements of the antennas 40 in antenna board 100). Openings may be formed in ground traces 126 to accommodate impedance-controlled transmission line paths 102 (e.g., ground traces 126 may form the ground conductor of impedance-controlled transmission line paths 102 whereas impedance-controlled transmission line paths 102 include signal conductors formed from conductive traces in the openings).

Each impedance-controlled transmission line path 102 may extend from a respective signal interconnect structure 98S (e.g., conductive vias may extend from signal interconnect structures 98S to the conductive traces in the openings formed by ground traces 126) to a corresponding feed via F. Each feed via F may extend in the −Z direction to a corresponding antenna feed terminal on the antenna resonating element of a given antenna 40 in antenna board 100. As shown by exploded view 124, the signal conductors in impedance-controlled transmission lines 102 may have thicker portions that are used to form matching segments 112. Any desired number of thicknesses may be used to form matching segments 112 (e.g., matching segments 112 of FIG. 13 perform two step matching). There may be separate impedance-controlled transmission lines 102 for conveying low band millimeter/centimeter wave signals and for conveying high band millimeter/centimeter wave signals. This arrangement may also support dual/multi-band matching within the same solder bump/transmission line.

As shown in FIG. 13, conductive vias 128 may extend in the Z direction through antenna board 100 (e.g., to short ground traces in antenna board 100 together). Fences of conducive vias 128 may laterally surround impedance-controlled transmission lines 102. Fences of conductive vias 128 may also laterally surround each antenna 40 in antenna module 84. For example, each antenna 40 may be located within a respective cavity 130, where the cavity has an upper edge defined by ground traces 126 and lateral edges defined by conductive vias 128. The example of FIG. 13 is merely illustrative and, in general, other transmission line routing schemes may be used.

Figure 14:
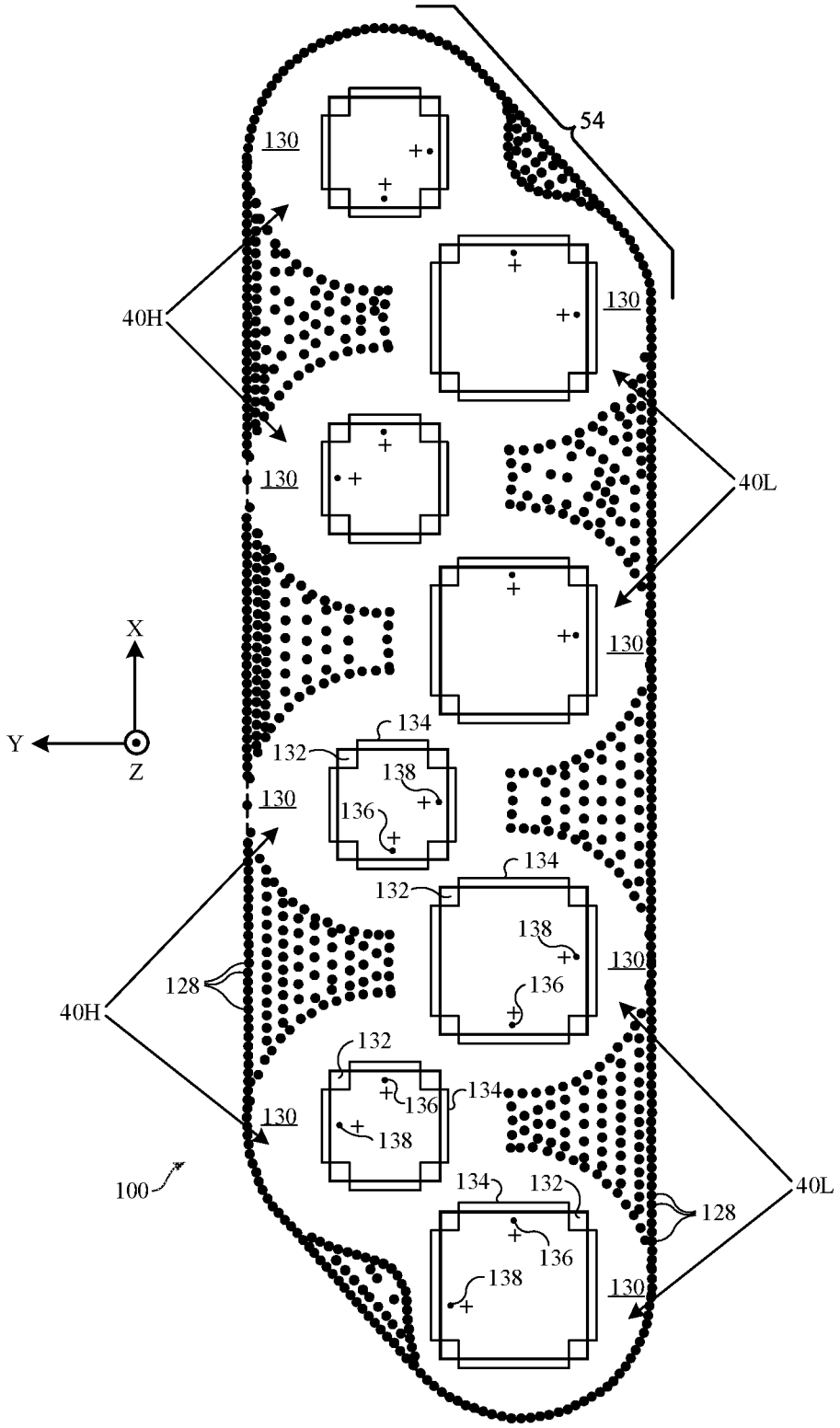
FIG. 14 is a top-down view of illustrative antennas in an antenna board of a logic-board-integrated antenna module in accordance with some embodiments.

FIG. 14 is a top-down view of antenna board 100 of FIG. 13 but where ground traces 126 of FIG. 13 have been removed to reveal the underlying antennas 40 in antenna board 100. As shown in FIG. 14, antenna board 100 may include a set of antennas 40L and a set of antennas 40H that collectively form the antennas of phased antenna array 54. In this example, antennas 40L may cover a relatively low millimeter/centimeter wave frequency band (e.g., a 26.5-29.5 GHz band) whereas antennas 40H cover a relatively high millimeter/centimeter wave frequency band (e.g., a 37-40 GHz band). This is merely illustrative and, in general, phased antenna array 54 may cover any desired number of frequency bands at any desired frequencies using any desired number of sets of antennas.

In the example of FIG. 14, antennas 40L and 40H are patch antennas having stacked patch antenna resonating elements (sometimes referred to herein as stacked patch antennas). Each of antennas 40L and 40H includes a corresponding patch antenna resonating element 132 (sometimes referred to herein as patch 132, patch element 132, or patch antenna radiating element 132). The dimensions of patch 132 may be selected to configure the antennas to radiate in a desired frequency band. Each patch 132 is fed using at least one positive antenna feed terminal. In the example of FIG. 14, each patch 132 is fed using two positive antenna feed terminals (e.g., for covering orthogonal linear polarizations, elliptical polarizations, and/or circular polarizations). For example, each patch 132 may be fed using a first positive antenna feed terminal 136 (e.g., for covering a first linear polarization) and a second positive antenna feed terminal 138 (e.g., for covering a second linear polarization orthogonal to the first linear polarization). This is merely illustrative and, in general, other feeding arrangements may be used. Positive antenna feed terminals 136 and 138 may each be coupled to a respective impedance-controlled transmission line 102 by a corresponding feed via F (FIG. 13).

As shown in FIG. 14, each antenna 40L and each antenna 40H also includes a parasitic element 134 underlying the corresponding patch 132 (e.g., patch 132 may be interposed between a corresponding parasitic element 134 and ground traces 126 of FIG. 13). Parasitic elements 132 may be formed from patches of conductive traces on antenna board 100 and may sometimes be referred to herein as parasitic antenna resonating elements 132, parasitic patches 132, or parasitics 132. Parasitic elements 132 may serve to widen the bandwidth of antennas 40L and 40H (e.g., by contributing additional resonances to the antenna). In the example of FIG. 14, parasitic elements 134 are cross-shaped patches having arms overlapping positive antenna feed terminals 134 and 136 (e.g., for performing impedance matching). Each antenna 40L and each antenna 40H may be located within a corresponding cavity 130 in antenna board 100. Cavities 130 (e.g., the conducive vias 128 defining the lateral edges of cavities 130) may help to isolate the antennas from other components and reduce sensitivity to system tolerances. Antennas 40L and 40H may radiate in the hemisphere below antenna board 100 (e.g., in the −Z direction of FIG. 14).

The example of FIG. 14 is merely illustrative. Patch elements 132 and parasitic elements 134 may have other shapes (e.g., any desired number of curved and/or straight sides). Phased antenna array 54 may include any desired number of antennas arranged in any desired pattern. Each antenna in phased antenna array 54 may be a multi-band antenna for covering multiple frequency bands if desired. The antennas in phased antenna array 54 need not be patch antennas and can be implemented using any desired antenna structures.

The foregoing is merely illustrative and various modifications can be made by those skilled in the art without departing from the scope and spirit of the described embodiments. The foregoing embodiments may be implemented individually or in any combination.

What is claimed is:

1. Apparatus comprising:

a logic board;

an antenna board surface-mounted to the logic board;

antennas on the antenna board and configured to radiate at a frequency greater than 10 GHz; and a radio-frequency integrated circuit surface-mounted to the logic board and comprising radio-frequency front end circuitry for the antennas.

2. The apparatus defined in claim 1, further comprising:

first solder balls that couple the antenna board to the logic board; and second solder balls that couple the radio-frequency integrated circuit to the logic board.

3. The apparatus defined in claim 2, wherein the logic board has opposing first and second surfaces, the antenna board is surface-mounted to the first surface using the first solder balls, and the radio-frequency integrated circuit is surface-mounted to the first surface using the second solder balls.

4. The apparatus defined in claim 3, further comprising:

transmission line structures in the logic board that couple the first solder balls to the second solder balls.

5. The apparatus defined in claim 4, wherein the transmission line structures comprise a first impedance matching segment at the first solder balls and a second impedance matching segment at the second solder balls.

6. The apparatus defined in claim 2, wherein the logic board has opposing first and second surfaces, the antenna board is surface-mounted to the first surface using the first solder balls, and the radio-frequency integrated circuit is surface-mounted to the second surface using the second solder balls.

7. The apparatus defined in claim 6, further comprising:

transmission line structures in the logic board that couple the first solder balls to the second solder balls.

8. The apparatus defined in claim 7, wherein the transmission line structures comprise a first impedance matching segment at the first solder balls and a second impedance matching segment at the second solder balls.

9. The apparatus defined in claim 6, further comprising:

a vertical passthrough that extends through the logic board to couple the first solder balls to the second solder balls.

10. The apparatus defined in claim 2, wherein the antenna board comprises:

transmission line structures that couple the first solder balls to antenna resonating elements of the antennas.

11. The apparatus defined in claim 10, wherein the transmission line structures comprise an impedance matching segment at the first solder balls that is configured to match an impedance of the first solder balls to an impedance of the antennas.

12. The apparatus defined in claim 11, wherein the logic board further comprises additional transmission line structures that couple the first solder balls to the second solder balls and that comprise a first additional impedance matching segment at the first solder balls and a second additional impedance matching segment at the second solder balls.

13. The apparatus defined in claim 1, wherein the antennas are arranged in a phased antenna array.

14. The apparatus defined in claim 13, wherein the radio-frequency front end circuitry comprises phase and magnitude controllers for the phased antenna array that are configured to steer radio-frequency signals conveyed by the antennas at the frequency.

15. The apparatus defined in claim 1, wherein the apparatus is an electronic device, the electronic device having opposing first and second faces, and the electronic device comprising:

a display at the first face; and a dielectric cover layer at the second face, wherein the antennas are configured to radiate through the dielectric cover layer.

16. The apparatus defined in claim 15, wherein the logic board comprises a main logic board for the electronic device.

17. The apparatus defined in claim 1, wherein the radio-frequency integrated circuit comprises a system in package (SIP) surface-mounted to the logic board.

18. A logic-board-integrated antenna module comprising:

a logic board;

a printed circuit board mounted to the logic board;

an array of antenna resonating elements patterned on the printed circuit board and configured to radiate at a frequency between 10 GHz and 300 GHz;

a package mounted to the logic board, the package comprising radio-frequency front end circuitry for the array of antenna resonating elements; and transmission line structures on the logic board, wherein the transmission line structures couple the radio-frequency front end circuitry to the array of antenna resonating elements patterned on the printed circuit board.

19. The logic-board-integrated antenna module defined in claim 18, wherein the transmission line structures comprise an impedance matching segment configured to match an impedance of the radio-frequency front end circuitry to an impedance of the array of antenna resonating elements.

20. Apparatus comprising:

a logic board;

a package mounted to the logic board and having radio-frequency front end circuitry; and an antenna board mounted to the logic board and having antennas configured to radiate at a frequency between 10 GHz and 300 GHz, wherein the logic board is configured to form a radio-frequency interface between the radio-frequency front end circuitry in the package and the antennas in the antenna board.

* * * * *